US010060181B1

(12) United States Patent
Jones, Jr. et al.

(10) Patent No.: US 10,060,181 B1
(45) Date of Patent: Aug. 28, 2018

(54) HYBRID HARDENED BALLISTIC SECURITY DOOR

(71) Applicant: NetTalon Security Systems, Inc., Fredericksburg, VA (US)

(72) Inventors: Donald R. Jones, Jr., New Canton, VA (US); Len R. Christensen, Florence, OR (US)

( * ) Notice: Subject to any disclaimer, the term of this patent is extended or adjusted under 35 U.S.C. 154(b) by 0 days.

(21) Appl. No.: 15/728,557

(22) Filed: Oct. 10, 2017

(51) Int. Cl.
*E06B 3/00* (2006.01)
*E06B 5/10* (2006.01)

(52) U.S. Cl.
CPC ..... *E06B 5/10* (2013.01)

(58) Field of Classification Search
CPC . E06B 5/10; F41H 5/007; F41H 5/023; F41H 5/0464; F41H 5/0471; F41H 5/0485
USPC ..... 49/501
See application file for complete search history.

(56) References Cited

U.S. PATENT DOCUMENTS 5,269,111 A * 12/1993 McDougall ..... E06B 3/5892 49/171
5,349,893 A * 9/1994 Dunn ..... F41H 5/04 2/2.5
5,624,622 A * 4/1997 Boyce ..... B29C 44/569 264/258
5,773,121 A * 6/1998 Meteer ..... B29C 70/086 156/145
5,970,843 A * 10/1999 Strasser ..... F41H 5/0435 2/2.5
6,200,664 B1 * 3/2001 Figge ..... B32B 3/18 428/178
2004/0132368 A1 * 7/2004 Price ..... B32B 5/26 442/247
2006/0254153 A1 * 11/2006 Clancy ..... E06B 5/11 49/501
2009/0208914 A1 * 8/2009 Phillips ..... G09B 9/00 434/219
2010/0300275 A1 * 12/2010 Warren ..... F41H 5/0492 89/36.02
2011/0048292 A1 * 3/2011 Zimmer, II ..... E05G 1/026 109/64
2012/0118135 A1 * 5/2012 Warren ..... B60J 1/2011 89/36.02

(Continued)

*Primary Examiner* — Jerry E Redman
(74) *Attorney, Agent, or Firm* — Scott E. Gilbert

(57) ABSTRACT

An innovative ballistic door is disclosed that is destined for use in schools, offices and building structures. The innovative door comprises a hybrid ballistic core, comprising at least two sections, wherein one section is a heavy impact resistant material rated to NIJ level III strength to resist rounds fired from high-powered rifles, as well as resisting breaches from explosive devices such as pipe bombs and the like. AR500 steel plate having a thickness of ¼ inch meets this requirement. The remaining sections of the innovative ballistic hybrid core comprise at least one lighter-weight ballistic sheet material, such as E Glass fiber composite sheet, which at least comply with the NIJ level IIIA standard. This E Glass material is ideally suited to resist the impact of a pipe bomb explosion. The novel ballistic core construction allows a compromise between protective and practical weight requirements. In addition, the innovative ballistic door provides for substantial anti-breach protection of the latch and lock mechanism and hinges.

22 Claims, 5 Drawing Sheets

(56) References Cited

U.S. PATENT DOCUMENTS

| | | | | |
|---|---|---|---|---|
| 2012/0137865 | A1* | 6/2012 | Citterio | F41H 5/0428 89/36.02 |
| 2012/0266745 | A1* | 10/2012 | Warren | F41H 5/0414 89/36.02 |
| 2016/0178329 | A1* | 6/2016 | Gibson | F41H 5/06 89/36.02 |
| 2016/0327374 | A1* | 11/2016 | Sexton | B32B 15/20 |
| 2017/0241173 | A1* | 8/2017 | Presutti | E05C 19/005 |
| 2017/0248391 | A1* | 8/2017 | Andresen | F41H 5/0464 |
| 2017/0254625 | A1* | 9/2017 | Spransy | F41H 5/0464 |
| 2017/0299347 | A1* | 10/2017 | Fultz | F41H 5/226 |
| 2018/0087879 | A1* | 3/2018 | Glover | F41H 5/0478 |
| 2018/0156577 | A1* | 6/2018 | Navin | F41H 5/007 |

* cited by examiner

HYBRID HARDENED BALLISTIC SECURITY DOOR

FIELD OF THE TECHNOLOGY

The innovation relates to ballistic door technology, and the creation of light- to medium-weight ballistic doors that are effective in resisting breaches from significant threats and small explosive devices.

BACKGROUND

Recent shootings in schools, universities and office buildings, as well as and the growing threat of mass shootings, homegrown terrorists and foreign terrorist groups such as ISIS, have prompted a demand for ballistic building components, particular doors and windows, which meet aesthetic and practical requirements. To date, ballistic doors that can resist serious breaches by high-power rifle fire and explosive devices like pipe bombs and grenades are generally too heavy or unwieldy to serve as classroom doors or office doors. On the other hand, ballistic doors that are lightweight and more streamlined to meet weight requirements for standard doors in such institutions typically are made from materials that cannot resist rifle fire, and thus may not protect the occupants of a room or office from such fire. In addition, little attention is usually paid to protecting the latch or hinges, areas that are vulnerable to breach by being first shot at then attacked with a breeching tool, e.g. a short-handled crowbar. So, even if the door itself can resist gunfire from high-powered weapons, it can fail in the subsequent attack at the weakened point.

SUMMARY

It is an object of the instant innovation to deny shooter or other threatening person entry, or breach, into a protected space such as a school or college classroom, building or office, as well as hospital and hotel/motel safe rooms, and to stop or minimize bullet penetration, bullet ricochets and any fragmentation of bullets. It is a further object of the instant innovation to provide a light- to medium-weight hardened ballistic door for installations at points of entry into a school or college classroom, office or building, as well as hospital and hotel/motel safe rooms, that achieves the goals of the first stated object.

Herein disclosed is a hybrid light- to medium-weight ballistic door comprising an interior core, wherein the hybrid interior core comprises at least two components, wherein at least one component is lightweight relative to the weight of the complementary component or components. In some embodiments, the inventive hybrid interior core comprises a first component that is substantially comprised of an impact-resistant metal plate, preferably steel, such as impact-resistant abrasion resistant AR500 specialty steel plate, and a relatively lightweight second component, substantially comprised of ballistic E Glass sheet composite, wherein the AR500 steel plate component and E Glass composite sheet component are juxtaposed such that they form a hybrid interior core.

In some embodiments, the impact-resistant steel plate and E Glass composite sheet are juxtaposed such that they form a contiguous hybrid interior core, that is, there is no space between the two components. In other embodiments of the innovative ballistic door, the inventive hybrid core may comprise more than two components.

The use of two or more ballistic components in the innovative core is to compromise between protection and practical weight requirements. It will be shown later that the innovative door effectively restricts potential breaches and reduces the shooting fan of any direct fire in the room by positioning the lighter ballistic glass on the hinge side thus narrowing the fan or angle where bullets could enter the room. The materials comprising the core and the protective features of the door are chosen so that entry is denied to a shooter, and attempts to breach the door by gunfire would require significant time. Additionally, the restricted shooting fan allows for a safe zone to exist outside of the shooting fan, typically in a protected corner of the room. Thus, the protective advantage of the instant ballistic door has the compound effect of thwarting attempts to enter the room, creating a safe zone within the room giving and giving the occupants in a room enough time to take cover within the protected space of the safe zone.

The disclosed innovative hybrid core at least partially fulfills the second stated object of providing a medium weight hardened ballistic door. As stated above, it is an object of the instant innovation that the hybrid ballistic door prevent entry into a protected space by a shooter or other threatening person. Breach of security and ballistic doors may be attempted or accomplished typically by destroying the door latching or locking mechanism, and the hinges, mainly by shooting these areas of the door with the shooter's weapon, but also by use of homemade small bombs, such as pipe bombs.

Another means of breach entry is by means of a vision window that is part of many types of institutional doors that are used in school rooms, lecture halls, offices, as well as hospital and other institutional offices, conference rooms and patient rooms in hospitals. In such a situation, a threatening person such as a shooter may break the window by shooting it to break the window out of its frame, or to create an opening large enough to reach through and access the interior handle latch to open the door. Here, the window may be located above the handle latch, and close enough to be within arm's reach.

To address this means of breach, an aspect of the instant innovation is a vision window comprised of a ballistic glass, preferably a glass that at minimum meets level IIIA of the 0101.03 and 0101.04 NIJ (National Institute of Justice) standards, to mitigate destruction by small arms fire in the first place, and wherein the ballistic vision window is disposed at a distance from the latch or locking mechanism of the door such that the latch or locking mechanism is out of arm's reach even for a large man. A window meeting the level IIIA standards would stop .44 magnum bullets. Further, the window after being subjected by gunfire, must be able to withstand a breech attack by the butt of a weapon or a breeching tool. Neither NIJ nor UL test a combination of weapons fire and a breech attack to determine if the window will stay intact.

In the preferred embodiment of the instant innovation, the latching and locking mechanism may be made to be surrounded by lock armor to protect the lock's integrity against gunfire. Additionally, in some embodiments, the latch area is covered by the lock armor. In some embodiments, the door jamb or frame is extended in order to cover the gap between the door and the jamb when the door is closed and the latch is extended into the jamb, which is a normally vulnerable area for a forced breach by gunfire. In some embodiments, a mortise lock is used as the latching mechanism as it is considered to be stronger and more durable than a cylindrical lock.

A secondary aspect of the instant innovation is to prevent a breach of the door by destruction of the door hinges. In some embodiments, a continuous hinge affixes the innovative hybrid door to a frame. Discreet hinges that are typically used in door installations are vulnerable to being weakened or destroyed by gunfire or explosion. A continuous hinge would still most likely be sufficiently intact even after experiencing an explosion to still function, and most importantly to maintain its structural integrity, and as a means of attaching the door to a door frame.

In some embodiments, the vision window material of the instant innovation is constructed to meet NIJ level IIIA standards at minimum. In some embodiments, the inventive ballistic window material comprises multiple layers of a polycarbonate composite. As an example, the inventive ballistic window may comprise a stack of eleven layers of polycarbonate sheet, where each sheet may be up to 0.19 inch-thick (approx. 5 mm), having a suitable adhesive bond between each layer. One example is a urethane-based adhesive. The inventive window material has been shown to stop multiple pistol rounds of up to 0.44 magnum size shot from about 15 feet. Such a window will not spall glass splinters on the backside, and will not collapse with multiple gun fire types. For example, 12-gauge shotgun shot and 9 mm pistol rounds will not collapse the innovative vision window. In addition, the innovative vision window would not collapse under a breach attack with a breaching tool, such as the butt of a weapon, a section of 2×4 wood, or a crow bar, for up to one minute.

Advantageously, the innovative window material does not collapse under gunfire, so the shooter cannot break through the window without expending a very large number of rounds. Nevertheless, the shooter may shoot rounds into the protected space using a rifle. However, due to the small width and height of the window, the shooter would have limited angle of view and a limited lateral range from his position outside of the door to be able to shoot within the space at oblique angles. In other words, the shooter would have a small shooting fan, effectively limiting the lateral range of fire. As an example, the shooting fan may cover an angle of about 35° to 40° as measured from the window. Inside the protected space, a shooting fan of such an angle would only cover a portion of the space, which may be approximately half of the room area or less. In some embodiments, the innovative door is typically disposed near one side of the space. The limited shooting fan leaves a large portion of the room protected from gunfire. Within this protected region outside of the shooting fan, occupants of the space may safely take cover out of the shooting fan or line of fire, while external emergency measures may be automatically set forth to thwart and subdue the shooter, who is still in the hallway.

DETAILED DESCRIPTION

Figure 1:
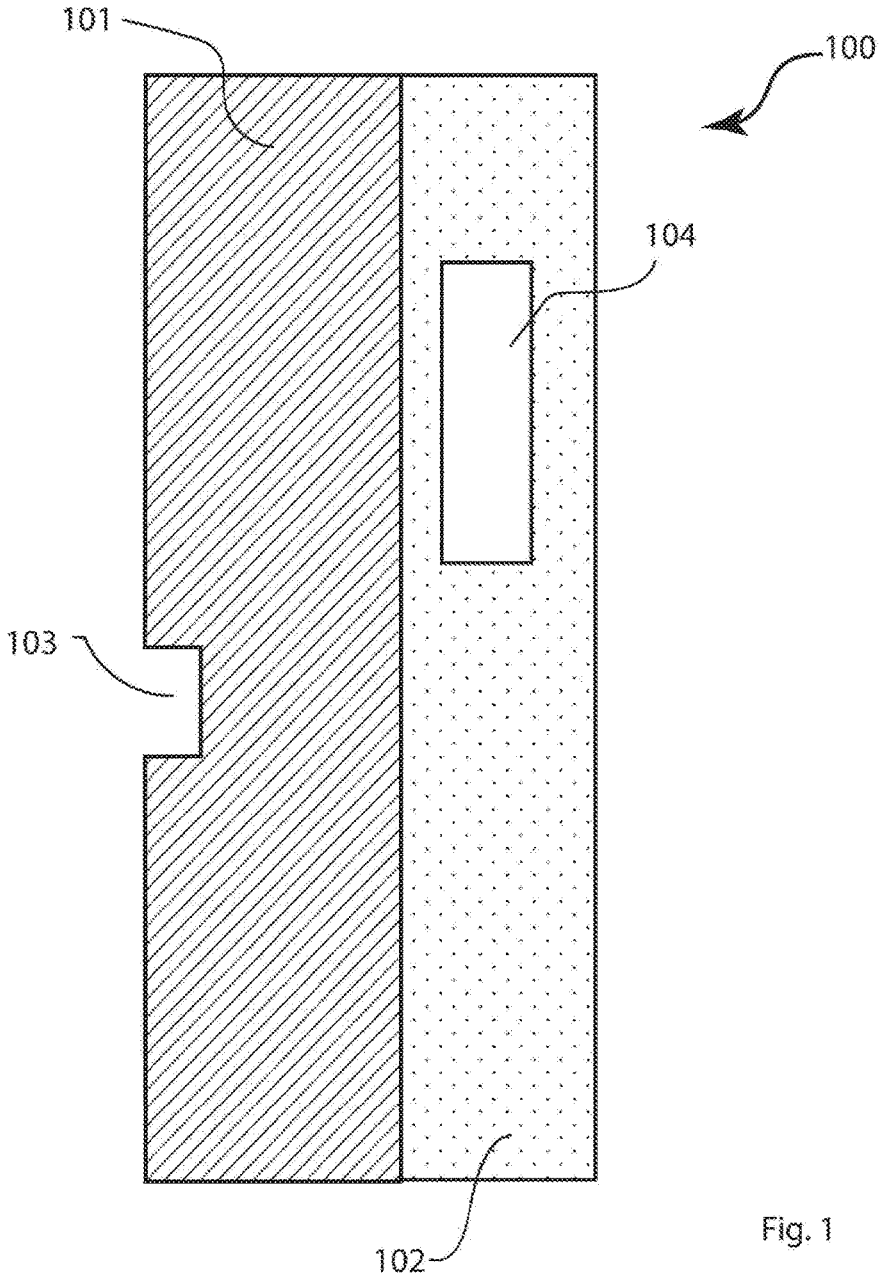
FIG. 1 Shows a frontal view of the pre-assembled innovative ballistic core preferred embodiment of the inventive ballistic door.

FIG. 1 shows an embodiment of a pre-assembled hybrid ballistic door core 100, which comprises high impact-resistant section 101. In some embodiments, high impact-resistant section 101 comprising high impact steel meeting NIJ level III standards. In some embodiments, section 101 is disposed adjacently to a lighter weight high-impact section 102. In some embodiments, section 102 is an E Glass fiber composite sheet, having a lower breach threshold, for example, meeting NIJ level IIIA standards.

In some embodiments, the use of the two types of ballistic materials in the hybrid core is a compromise between protection and weight requirements. It will be shown below that that configuration of the innovative hybrid core effectively restricts a shooting fan, as the ballistic glass core is on the right side of the door, thus greatly reducing the direct fire fan into the room. In the illustrated embodiment shown in FIG. 1, section 101 is disposed on the left of section 102 assuming a standard where the latch/lock is built into the left side of the door. However, the disposition of sections 101 and 102 may be equally reversed without consequence, depending on the desired configuration of the door. In some embodiments, latch cutout 103 is disposed on the left edge of steel section 101 to accommodate a latch/lock mechanism such as a mortise lock. In some embodiments, vision window inset 104 is disposed within E Glass fiber composite section 102. In some embodiments, vision window 104 is disposed in the upper portion of section 102.

In some embodiments, vision window 104 is disposed at a distance from region 103. In some embodiments, the distance is longer than the length of a large man's arm extending through vision window 104. In some embodiments, the distance is longer than a man's arm extending from one side of the door to reach latch cutout 103, where it would be possible for a perpetrator to breach vision window 104 and unlock the door from the inside. As an example, an effective distance of approximately 30 inches (75 cm) from the bottom of window inset 104 to the center of region 103, which may exceed the length of an arm extending from window 104 attempting to reach the inside door latch.

In some embodiments, section 101 comprises AR500 steel plate, however suitable materials are not limited to AR500 alloy steel plate, and other high-impact steel or other metal alloys that meet the NIJ level III standard at minimum are equally suitable. In some embodiments, E Glass section 102 meets the NIJ level IIIA standard. The NIJ standard requires that the material can substantially resist fire from handguns including 0.44 magnum rounds, including 15.55 g (240 gr) semi-jacketed hollow-point rounds, and 8 g (124 gr) full metal jacketed 9 mm rounds fired at velocities of 1400 ft/s or less, and but may not resist rounds fired from high-powered rifles.

In some embodiments, section 101 substantially resists high-powered rifle fire. The combination of the two ballistic materials provides for a light- to medium-weight, highly impact-resistant core. For example, if ¼ inch (6 mm) thick AR500 plate is used, its unit weight per square foot is approximately 10 lbs/ft$^2$ (50 kg/m$^2$). For a 7/16 inch (11 mm) thick sheet of ballistic E Glass fiber composite sheet (NIJ level IIIA), the unit weight is approximately 4.8 lbs/ft$^2$ (24 kg/m$^2$), less than one half that of the AR500 plate. By way of example, a ballistic core may have overall dimensions of 34.5 inches×82.375 inches.

Again, by way of example, the AR500 plate may span 58% of the overall width of the core, and the remaining 42% is spanned by the ballistic E-glass fiber composite sheet would weigh approximately 154 lbs (70 kg), This is contrasted to a core weight of approximately 200 lbs (90.8 kg) if the core was completely composed of ¼ inch (6 mm) AR500 plate. By constructing the core from the steel plate and E Glass composite sheet, the weight of the door may be significantly reduced in comparison to a door built entirely from steel plate, thereby meeting door weight restrictions.

Figure 2:
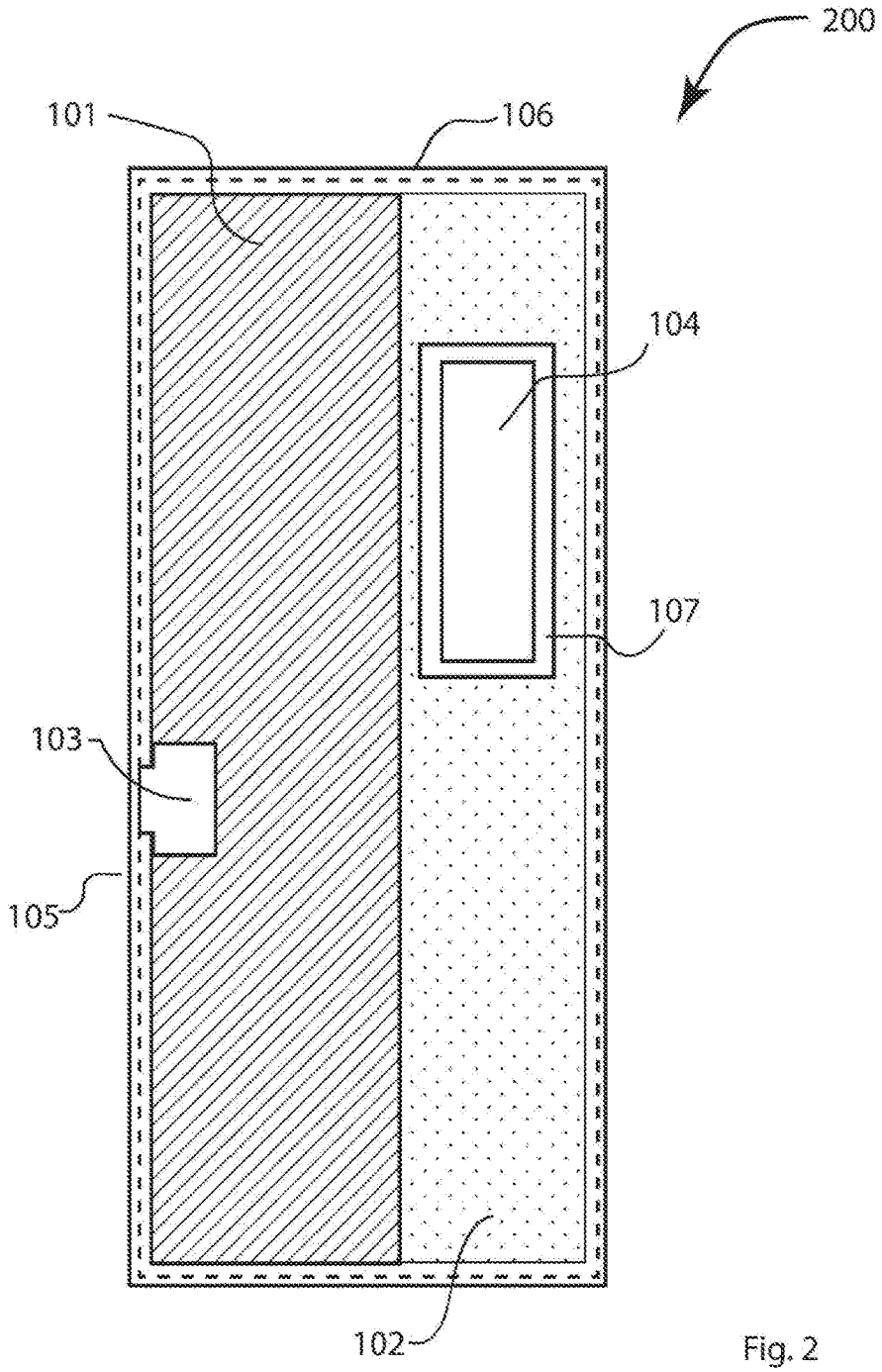
FIG. 2 Shows a frontal view of the innovative ballistic core embodiment assembled.

FIG. 2 shows another embodiment of door core assembly 200, where the steel plate/E Glass fiber composite core members 101 and 102 are girded by frame comprising structural members 105 and 106, where the frame comprised of structural members 105 and 106 mechanically binds core members 101 and 102 together and forms a rigid core structure 200. By way of example, frame structural members 105 and 106 may be constructed from AR500 angle steel, which may meet NIJ level IIIA standards, fastened together with high hard security hardware.

At the position of latch cutout 103, frame member 105 may be notched as shown in FIG. 2 to accommodate a lock such as a mortise lock. In some embodiments, core assembly 200 is completed with frame 107 surrounding window cutout 104. In some embodiments, Frame 107 holds the innovative ballistic window insert, which comprises a stack of laminated plastic sheets, according to some embodiments. However, the composition of the window insert is by no means limited to laminates. In some embodiments, other types of ballistic glass (inorganic), polymers and composites that at least meet NIJ level IIIA standards, are equally employed. If laminates are used, the composition of the sheets may comprise materials such as, but not limited to, polycarbonate sheets, combination of polycarbonate and silica-based glass sheets, polyester sheets, and combinations thereof.

Other suitable materials are considered equivalent. In some embodiments, the ballistic window insert is an 11-layer polycarbonate laminate sheet stack, bonded by a transparent adhesive, such as a urethane-based liquid adhesive. Ballistic characteristics of this window assembly comprise no exit spall, meaning the innovative window insert will not spall glass splinters on the backside when struck by gunfire rounds. Additionally, the innovative window insert exhibits breach integrity, wherein the window resists blows with the butt of a rifle or handgun, a length of 2×4, a crow bar, etc., for at least 3 minutes, and will not collapse or break through. These ballistic characteristics substantially meet NIJ level IIIA standards.

Figure 3:
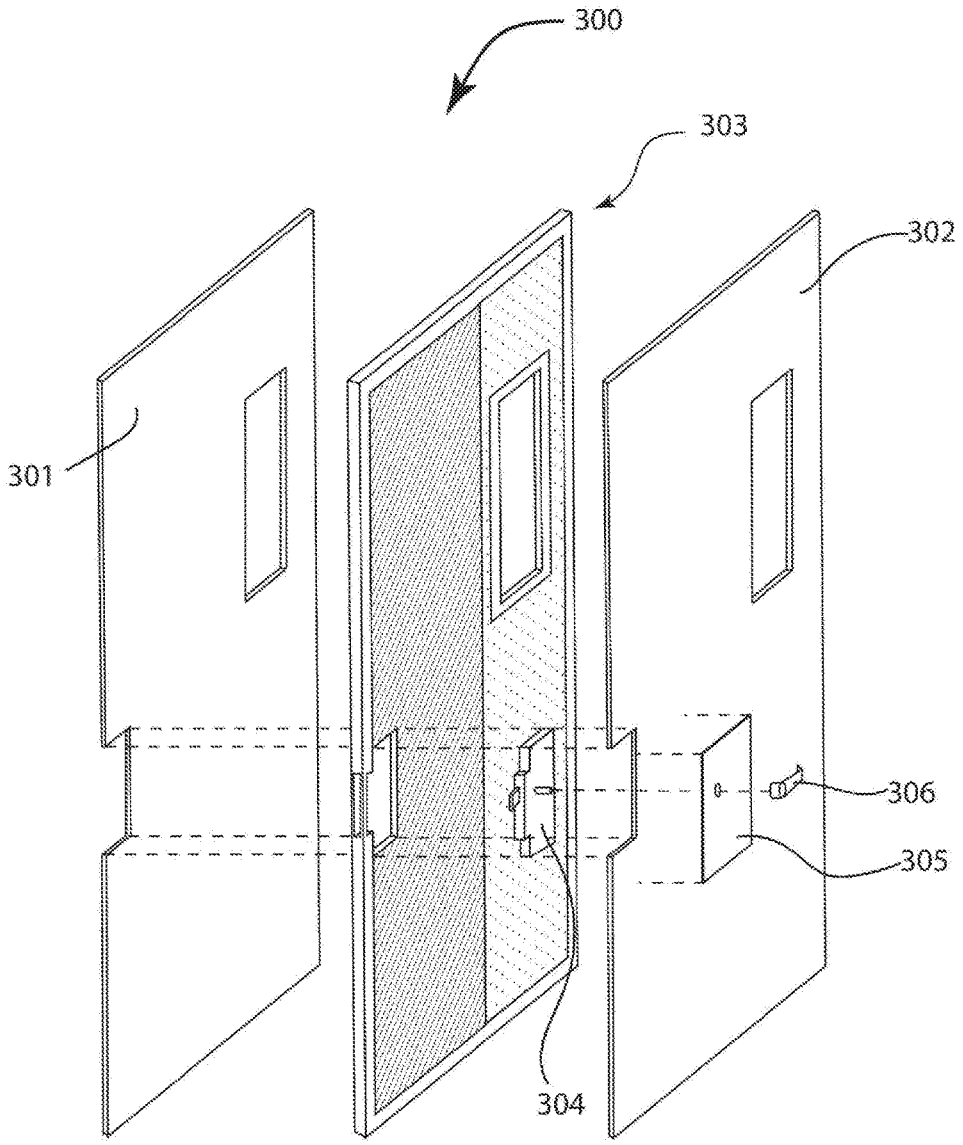
FIG. 3 Shows an exploded view of the assembly components of the inventive ballistic door, preferred embodiment.

In FIG. 3, an exploded view of an embodiment of the finished innovative ballistic door 300 construction beyond the core level is shown, detailing the placement of the exterior sheets 301 and 302 over core 303, as well as the latch or lock mechanism 304. Exterior sheets 301 and 302 thus form a veneer, or skin, covering the innovative ballistic core 303. An example, exterior sheets 301 and 302 may be manufactured from aluminum aircraft plate, for example, from 6061-T6 and/or 7075-T6 aluminum plate. In addition, thin S-glass may be used, as well as high-strength wood veneer. The function of exterior sheets 301 and 302 is primarily to provide an aesthetic finish covering to the door, and no ballistic resistance may be required of the exterior sheets.

Still referring to FIG. 3, an additional ballistic steel plate 305 is shown, whose function is to protect lock 305 from a gunfire or explosion breach. In some embodiments, lock 305 is a hi-hardened mortise lock. In some embodiments, the interface between the body of lock 304 and the steel portion of the innovative core may be relatively structurally weak and more vulnerable to a breach. In some embodiments, lock plate 305 overlaps the interface region by a substantial amount, as well as to cover and protect the lock body itself. In some embodiments, lock plate 305 meets NIJ level IIIA standards.

As an example, lock plate 305 may be formed from 3/16-inch AR500 steel plate, extending at least 1 inch (2.5 cm) from the edge of the body of lock 304. In some embodiments, thicker plate is employed for greater protection. In other embodiments, Kevlar (e.g. Kevlar 745) and similar lightweight ballistic fabrics is added to further protect structurally weak interior regions of the inventive door. In some embodiments, lock plate 305 extends over the borders between the AR500 steel portion and E Glass fiber composite portion of the innovative core, the lock area and in corners of the frame.

Figure 4:
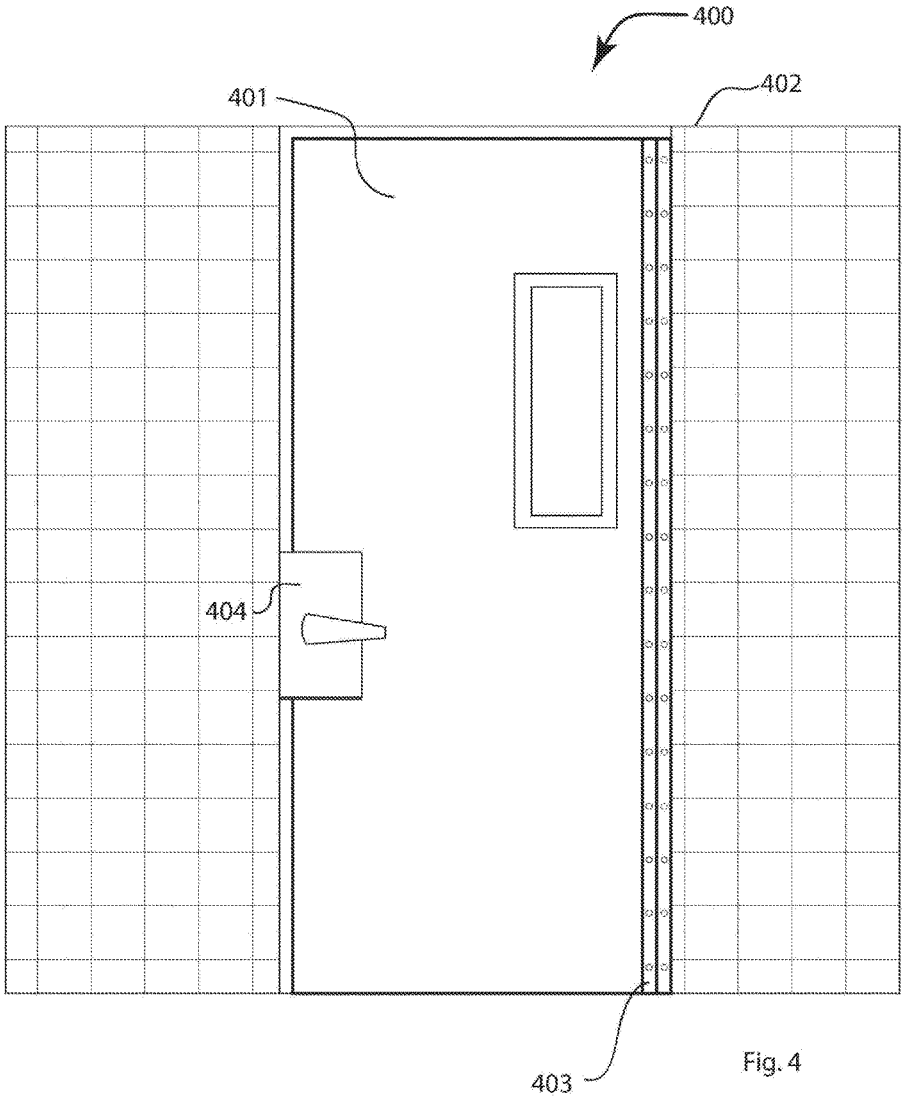
FIG. 4 Shows an installation of the inventive ballistic door in the wall of a room or office.

In FIG. 4, an installation embodiment 400 of ballistic hybrid door 401 is shown. The installation 400 also comprises wall 402, which may be of reinforced construction by a variety of suitable methods. Wall 402 may border an interior hallway, or may be an exterior wall. In some embodiments, wall 402 comprises cinder block brick. In some embodiments, the door casing or door frame is reinforced to meet NIJ level III standards. In some embodiments, ballistic hybrid door 401 comprises continuous hinge 403. In some embodiments, continuous hinge 403 is affixed to the articulating edge of the innovative ballistic door and attached to wall 402. In some embodiments, continuous hinge 403 is affixed to a reinforced door casing or hinge jamb. In some embodiments, continuous hinge 403 functions to provide integrity of the door-wall system by withstanding attack by gunfire or small bomb explosion.

Figure 5:
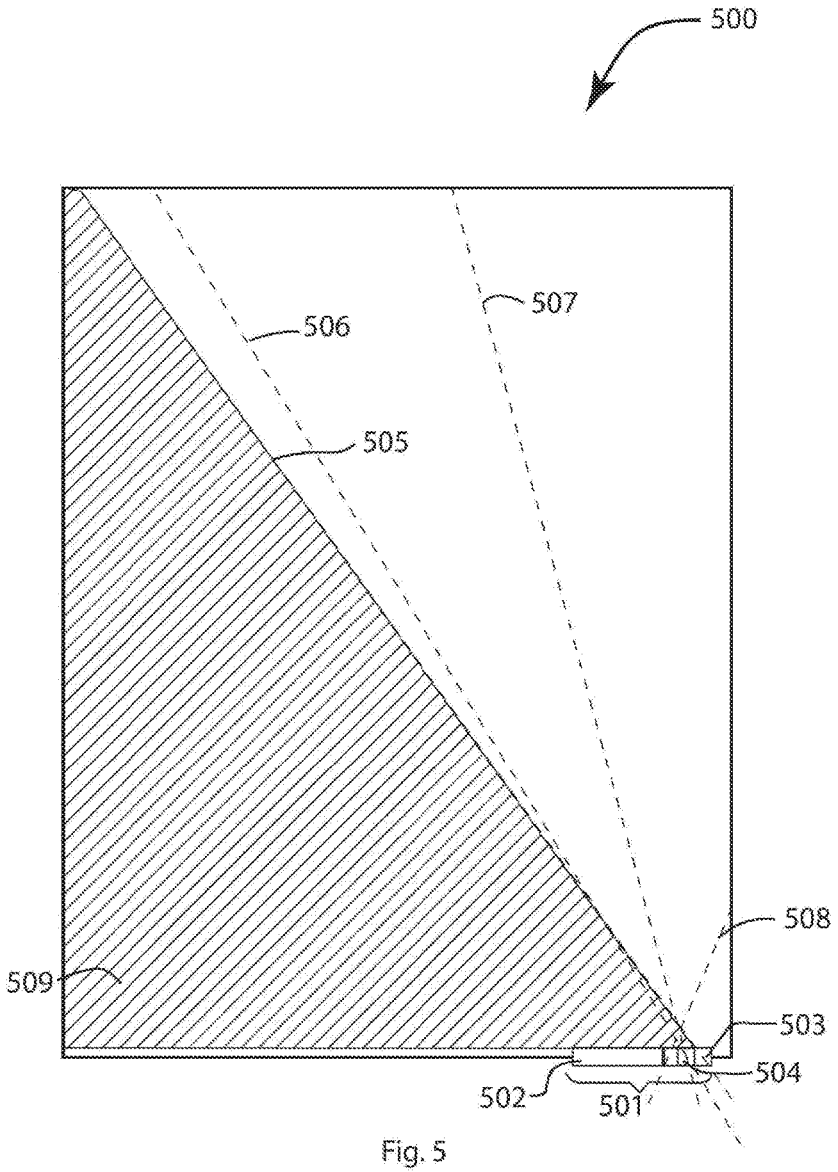
FIG. 5 Shows a schematic diagram of the deleterious effect by the inventive ballistic door on the achievable shooting fan due to the restricted lines of fire in case of a breach of the door.

With conventional doors, a shooter may attempt to destroy the hinges to make a breach possible by destroying the integrity of the door-wall system. By use of continuous hinge 403, this method of breach is substantially thwarted. In some embodiments, lock plate 404, as described above, overlaps the door jamb to the access to the latch and/or deadbolt portion of the lock, and the relatively weak structure around it is protected to the bullet-proof level As described above, hybrid ballistic door 401 provides a restricted shooting fan for a shooter armed with weapon powerful enough to pierce through the weaker regions of the inventive door. In FIG. 5, an interior room 500 is represented schematically by the rectangular region protected by the hybrid ballistic door 501, shown schematically. In some embodiments, hybrid ballistic door 501 is further divided into both portions of the core, with the NIJ level III region on the left represented by segment 502, and the NIJ level IIIA region represented by region 503 on the right, where the two regions are separated by the thick line. Vision window is represented by region 504.

Hypothetical lines of fire that would emanate from the exterior of the inventive door 501 are represented by the broken lines 505-508 in the figure. These lines of fire would be possible if the shooter successfully breaches vision window 504, and/or NIJ level IIIA region 503. It is understood that a breach of NIJ level III region 502 would not be possible, thus no fire would penetrate this region. Potential shooting fans are delineated between lines of fire 505 to 508. For example, a maximum shooting fan angle may be achieved if a shooter succeeds in firing through the right edge of door 501 into the room at an angle taken by line of fire 505. If the shooter fires at the door at a shallower angle, most likely the bullet will ricochet off and not penetrate. The shooter may shoot through the door from the inner edge of the NIJ level IIIA portion, and manage to penetrate at the angle taken by line of fire 508.

Thus, a potential shooting fan is delineated, with angle between line of fire 505 and 507 representing the maximum shooting fan angle. Line of fire 506 may potentially arise if the shooter manages to breach vision window 504, and fires from the extreme right side of the window. Line of fire 507 also arises if the shooter shoots through the window, but is more likely than line of fire 506, engendering an even more restricted shooting fan. Hybrid ballistic door 501 provides the advantage that the shooter, not knowing beforehand the construction of hybrid ballistic door 501, would first attempt to breach vision window 504 and fire through it.

The triangular region 509 on the left side of room 500 represents the safe region outside of the shooting fan. Region 509 is effectively a protected space, and occupants of the room would have time to take cover should a shoot attempt to breach the door. Even if the shooter successfully breaches the vision window, or manages to shoot through the NIJ level IIIA region 503, time would be needed to eventually breach through, giving the occupants time to take cover.

In further embodiments, the instant ballistic door may be electrified for two different purposes. For example, doors used in common spaces in a school or college that have open access such as an administration office, a library, or a cafeteria, may remain unlocked when the door is closed, but will lock automatically on the press of a key fob which is the device used to put the school in alert and lockdown. By way of example, all staff members may carry a fob. Classroom doors may also be electrified with the capability to be opened remotely through software installed at law enforcement tactical work stations in coordination with a security team if there was a hostage situation in the classroom. The security team may then make entry into the class.

While the disclosed embodiments describe preferred components, materials and configurations of the innovative ballistic door, it is understood by those skilled in the art that other embodiments may exist that are equivalent in purpose and function. Such embodiments that result in equivalent functionality do not depart from the scope and spirit of this innovation.

We claim:

1. A hybrid ballistic door, comprising:

a high-impact resistant ballistic core having a front surface and a back surface, wherein the high-impact ballistic core comprises:

a first high-impact resistant ballistic portion having an impact resistance corresponding to at least the NIJ Level III impact standard, the first high-impact resistant ballistic portion spanning the height of the hybrid ballistic door and a portion of the width and thickness of the hybrid ballistic door; and a second high-impact resistant ballistic portion having an impact resistance corresponding to at least the NIJ Level IIIA impact standard, said second high impact resistant ballistic portion being contiguous with the first high-impact resistant ballistic portion; and spanning substantially the remaining width of the hybrid ballistic door; and the first and second high-impact resistance ballistic portions having opposing edges that are positioned edge to edge to form the width of the hybrid ballistic door.

2. The hybrid ballistic door of claim 1, further comprising a vision window comprising a ballistic glass meeting having an impact resistance meeting at least the NIJ Level IIIA impact standard, wherein the vision window is disposed within the upper portion of the second high-impact resistant ballistic portion and displaced at least 20 inches laterally from the position of the latch, and displaced vertically at least 14 inches above the locking mechanism, so that the interior latch handle cannot be reached from outside the hybrid ballistic door in the event that the vision window is breached.

3. The hybrid ballistic door of claim 1, further comprising a ballistic fabric strip affixed to the front surface of the high-impact resistant ballistic core and spans the joint between the first and second high-impact ballistic core portions, said ballistic fabric strip having a length substantially equal to the length of the high-impact resistant ballistic core.

4. The hybrid ballistic door of claim 3, wherein the ballistic fabric is a flexible high-impact resistant woven material.

5. The hybrid ballistic door of claim 1, wherein the width portion comprises one vertical edge of the door, and wherein a locking mechanism is disposed therealong, the locking mechanism comprising an interior latch handle.

6. The hybrid ballistic door of claim 1, wherein the opposing edges of the first and second high-impact ballistic core portions form a joint, said second high-impact resistant ballistic portion spanning the height of the hybrid ballistic door and the remaining portion of the width of the hybrid ballistic door.

7. The hybrid ballistic door of claim 1, further comprising structural members girding the high-impact ballistic core and affixed to said high-impact ballistic core along the top and side edges, wherein adjacent structural members are affixed together so that the frame forms a substantially self-supporting rigid structure.

8. The hybrid ballistic door of claim 7, wherein said frame structural members are manufactured from a high-impact resistant ballistic material having an impact resistance corresponding to at least the NIJ Level IIIA standard.

9. The hybrid ballistic door of claim 1, wherein the high-impact ballistic core further comprises cutouts disposed within the first and second high-impact ballistic core portions to accommodate insertion of the locking mechanism and the vision window.

10. The hybrid ballistic door of claim 1, further comprising exterior sheets covering the front and rear faces of the high impact ballistic core, said exterior sheets having dimensions spanning substantially the height and substantially the width of the hybrid ballistic door.

11. The hybrid ballistic door of claim 10, wherein:

the exterior sheets are fabricated from S-glass sheet;

the exterior sheets comprise cutout portions having dimensions and positions coinciding with the positions and dimensions of the vision window and locking mechanism; or the exterior sheets are fabricated from wood veneer.

12. The hybrid ballistic door of claim 10, wherein the exterior sheets are fabricated from aluminum alloy.

13. The hybrid ballistic door of claim 12, wherein the aluminum alloy is selected from the group consisting of 6061-T6 and 7075-T6 aluminum plate.

14. The hybrid ballistic door of claim 1, wherein a high impact resistant ballistic armor plate is affixed on the front face of the hybrid ballistic door at a position corresponding to the position of the locking mechanism, and wherein the high-impact resistant ballistic plate is disposed over the body of the locking mechanism in such a way that the locking mechanism is covered by the high-impact resistant plate on the front face of the hybrid ballistic door.

15. The hybrid ballistic door of claim 14, wherein the high-impact resistant ballistic armor plate is fabricated from AR500 ballistic steel.

16. The hybrid ballistic door of claim 1, wherein a continuous articulating hinge is affixed to the outward vertical edge of the second high-impact resistant core portion of the hybrid ballistic door, the continuous articulating hinge spanning substantially the height of the hybrid ballistic door.

17. The hybrid ballistic door of claim 1, wherein the first high-impact resistant ballistic core portion is fabricated from AR500 steel plate.

18. The hybrid ballistic door of claim 1, wherein the second high-impact resistant ballistic core portion is fabricated from E Glass fiber composite sheet material.

19. The hybrid ballistic door of claim 1, wherein the ballistic glass of the window insert comprises an 11 layer stack comprising polycarbonate, urethane and heat-strengthened glass sheets, and wherein the ballistic glass withstands a breach attempt defined by a minimum of three minutes of rifle gunfire and strikes by a breaching tool.

20. A hybrid ballistic door system, comprising:

a hybrid ballistic door, comprising:

a high-impact resistant ballistic core having a front surface and a rear surface, comprising:

a first high-impact resistant ballistic portion having an impact resistance corresponding to at least the NIJ Level III impact standard, wherein the first high-impact resistant ballistic portion spans the height of the hybrid ballistic door and a portion of the width of hybrid ballistic door, and wherein the width portion comprises one vertical edge of the door, and wherein a locking mechanism is disposed therealong; and a second high-impact resistant ballistic portion having an impact resistance corresponding to at least the NIJ Level IIIA impact standard, said second high impact resistant ballistic portion being contiguous with the first high-impact resistant ballistic portion, wherein opposing edges of the first and second high-impact ballistic core portions form a joint, and wherein the second high-impact resistant ballistic portion spans the height of the hybrid ballistic door and the remaining portion of the width of the hybrid ballistic door.

21. The hybrid door system of claim 20, further comprising a vision window comprising a ballistic glass meeting having an impact resistance meeting at least the NIJ Level IIIA impact standard, wherein the vision window is disposed within the upper portion of the second high-impact resistant ballistic portion and displaced at least 18 inches laterally from the locking mechanism.

22. The hybrid ballistic door system of claim 20, further comprising a black-out scroll, to unroll over the view window when the fixation is released so that the view window is obscured.

* * * * *